United States Patent [19]

Akeel et al.

[11] 4,034,970

[45] July 12, 1977

[54] METHOD AND DEVICE FOR NODULARIZING CAST IRON

[75] Inventors: A. Hadi Kobaisi Abu Akeel, Sterling Heights; Richard C. Jackson, Bloomfield Hills, both of Mich.

[73] Assignee: General Motors Corporation, Detroit, Mich.

[21] Appl. No.: 652,907

[22] Filed: Jan. 28, 1976

[51] Int. Cl.[2] ..... C21C 1/00

[52] U.S. Cl. ..... 266/216; 75/130 B

[58] Field of Search ..... 75/130 R, 130 A, 130 AB, 75/130 B, 130 BB, 130 C; 266/200, 116, 117

[56] References Cited

U.S. PATENT DOCUMENTS

| | | | |
|---|---|---|---|
| 1,151,332 | 8/1915 | Baggaley | 266/216 |
| 2,260,226 | 10/1941 | Kirkham | 266/216 |

*Primary Examiner*—Gerald A. Dost

*Attorney, Agent, or Firm*—Peter P. Kozak

[57] ABSTRACT

A device and method for nodularizing cast iron which includes a funnel like portion including a mixing chamber having a tangential inlet which is operative to cause molten metal admitted to the chamber to assume a swirling configuration or vortex and a barrier portion positioned in the path of the swirling stream which is operative to cause the swirling stream to fold over itself and to promote mixing of the nodularization additive deposited into the vortex of the swirling metal.

7 Claims, 8 Drawing Figures

METHOD AND DEVICE FOR NODULARIZING CAST IRON

FIELD OF THE INVENTION

This invention relates to nodular or ductile iron and more particularly to a device and method for mixing a nodularization agent such as a magnesium containing alloy or a post inoculation agent such as a ferrosilicon alloy with molten cast iron to produce nodular or ductile cast iron.

DESCRIPTION OF THE PRIOR ART

The nodularization and graphitization of cast iron in the manufacture of nodular or ductile iron is generally done in a ladle or similar vessel on a batch basis. It has been known for some time that the nodularization and graphitization of the molten cast iron is not a permanent effect and tend to fade or decrease in intensity or degree when the metal is held in the ladle for some time before casting. To overcome this fading effect, in-stream nodularization and inoculation has been proposed whereby nodularizing and/or inoculation is performed within the stream of the molten metal as it is being poured into the mold or into a pouring vessel. Methods of accomplishing the in-stream nodularization include placing the nodularization agent such as a ferros magnesium alloy in a compartment associated with the runner system of the mold wherein it comes into contact with the molten metal as it is being poured into the mold cavity. It has also been proposed to inject the nodularization agent or inoculant agent into the molten metal stream as it leaves the orifice of a bottom pour ladle by means of a tube extending into the orifice and the metal stream.

Methods of in-stream inoculation well known to those skilled in the art include placing the inoculant such as a ferro-silicon alloy in particulate form within the gating system prior to pouring, locating the inoculant in the form of a perforated disc or other shape in the downspout of the gating prior to pouring, and immersing a bar of the inoculant material in the falling stream during casting.

In general, the shortcomings of the batch method of nodularization include the fade phenomenon previously mentioned, inefficient utilization of magnesium which markedly increase costs and slag formation on the treated iron which interferes with the smoothness of pouring and sometimes the casting quality.

The in-stream methods described above have one or more of the following shortcomings. These include nonuniform and inadequate mixing throughout the full extent of the pour, unreliability in mixing due to stream passage obstruction, and low efficiency in use of the additives.

SUMMARY OF THE INVENTION

The mixing device and method of the invention is effective and efficient for both nodularizing cast iron with magnesium or post inoculating the nodularized cast iron. Briefly, the device of this invention consists of a refractory body having a funnel-like mixing chamber with a tangentially positioned inlet and a cylindrical centrally positioned bottom pour outlet. The chamber has a substantial cylindrical portion in the vicinity of the inlet which causes the incoming molten metal entering the chamber to thereby assume a swirling configuration or vortex and has a barrier portion partially in the path of the swirling molten metal which causes the swirling stream to fold over itself to produce a turbulent flow for better mixing and to promote a faster flow into the vortex and outlet passage. The device preferably includes a closure means for sealing the chamber and a feed tube for feeding particulate additive material into the vortex at a controlled rate.

In operation, molten cast iron is poured into the chamber through the tangential inlet and the metal assumes a swirling configuration within the chamber. The barrier causes the stream to fold toward the center of the vortex. Simultaneously, the particulate additive is dropped into the vortex whereby turbulent mixing occurs with minimal loss of vaporized additive since the mixing occurs in an enclosed space and throughout the full extent of the pour.

Other advantages will be apparent from the following description, reference being had to the drawing in which.

DESCRIPTION OF PREFERRED EMBODIMENTS

The mixing apparatus of this invention is particularly useful in the casting of nodular or ductile iron which typically involves treating or mixing with molten gray cast iron a nodularizing agent such as magnesium or a suitable alloy thereof such as an iron-silicon-magnesium alloy containing about 5.0% magnesium by weight. Since magnesium is highly reactive with molten iron it is necessary to control the mixing so as to prevent disruptive explosions and the loss of magnesium.

Figure 1:
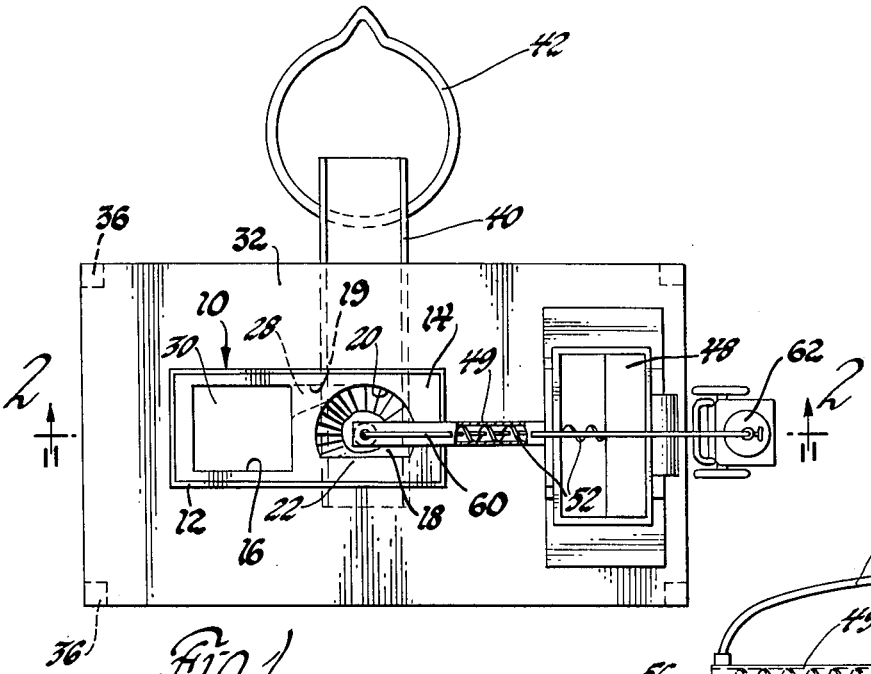
FIG. 1 is a top view of the mixing apparatus of this invention.
Figure 2:
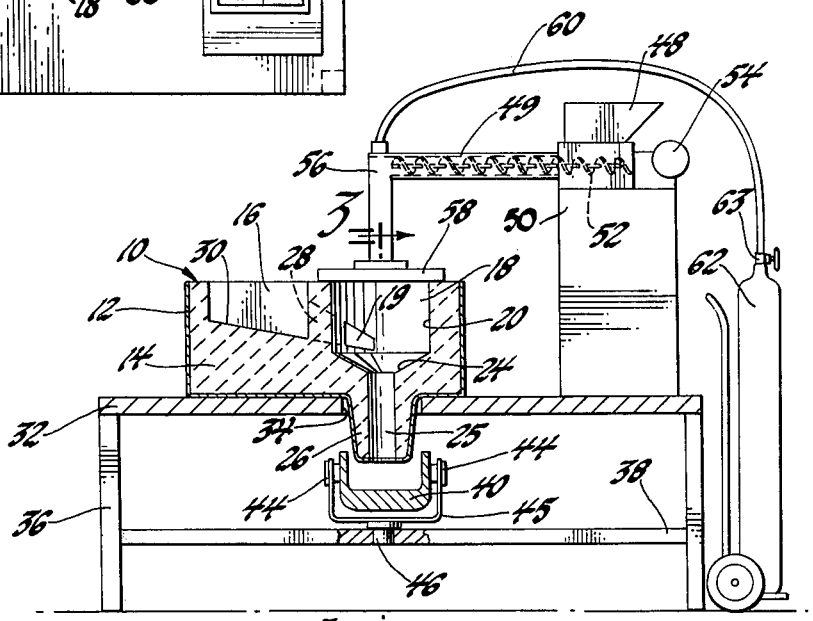
FIG. 2 is a cross sectional elevational view taken along the line 2—2 of FIG. 1.
Figure 3:
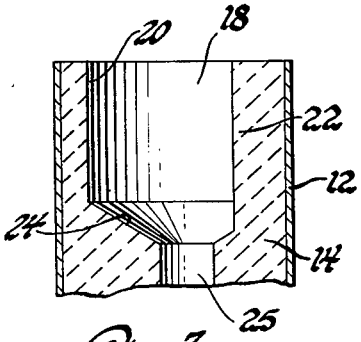
FIG. 3 is a cross sectonal view taken along the line 3—3 of FIG. 2.

Referring to FIGS. 1 and 2 of the drawings the apparatus of the invention comprises the main body 10 formed of the metal shell 12 and the refractory ceramic lining 14. The body 10 includes the molten metal receiving chamber or basin 16 and the funnel-like mixing chamber 18 consisting of a larger diameter partially cylindrical portion 20, the barrier portion 22 (FIG. 1) the frusto-conical portion 24 and the downspout 26 containing the cylindrical passage 25. A passage 28 extends from the receiving chamber 16 to the mixing chamber 18 with its outer wall 19 being tangentially disposed to the cylindrical wall of the mixing chamber 18. Preferably the receiving basin 16 has a base 30 which is slanted toward the passage 28 so that molten metal poured into the receiving basin 16 will be efficiently guided toward the passage 28. Preferably the passage 28 is also slanted as a continuation of the base 30.

The body 10 is supported on the metal plate 32 with the downspout 26 extending through the opening 34 therein. The table 32 is supported at each corner by the vertical legs 36 which also support a lower plate 38. The plate 38 supports the trough 40 positioned beneath the spout 26 for conveying the molten metal flowing therefrom to a pouring ladle 42 or the like. Preferably, as shown in FIG. 2 the trough 40 has the truanions 44 attached thereto which are pivotably attached to the bracket like support 45 rotatably supported on the lower plate 38 by means of the vertical shaft 46 or truanoin so that the outlet of the trough 40 may be moved as necessary for efficient use of the apparatus.

The apparatus includes means for dropping the particulate additive into the mixing chamber 18 in the form of a hopper 48 with a tubular extension 49 mounted on support 50. With the hopper 48 and extension 49 is the screw conveyor 52 driven by the motor 54 operative to convey the particulate material to a point substantially over the mixing chamber 18 at a measured rate. Preferably a conduit 56 sealingly connects the hopper extension 49 to a cover 58 and the conduit means 60 is provided for conveying nitrogen gas from the tank 62 to the pipe 56 so that an inert gas atmosphere may be maintained in the mixing chamber 18 during the mixing operation. The conduit 60 is connected to the tank 62 through a valve 63 for controlling the flow of the gas.

Figure 4:
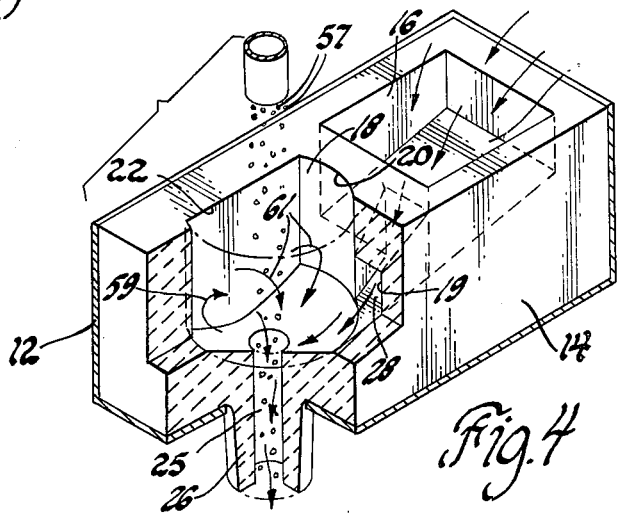
FIG. 4 is a perspective view of the apparatus showing the metal flow pattern therethrough.

An essential feature of the apparatus is the barrier portion 22 which interrupts the cylindrical configuration of the mixing chamber 18. A further important feature is the substantial length of the cylindrical passage 25 within downspout 26. In the operation of the apparatus and method the molten cast iron is poured into the receiving chamber 16 at a fixed rate. Simultaneously the conveyor 52 is placed in operation to drop the additive material into the conduit 56 at a fixed rate and the nitrogen gas is applied to the mixing chamber 18. FIG. 4 illustrates the resulting mixing operation as shown by the arrows. In this illustration the use of the nitrogen atmosphere has been omitted for ease of illustration.

The molten metal initially strikes the slanted base 30 of the basin 16 and thence through the passage 28 tangentially into the mixing chamber 18 wherein it assumes a swirling configuration as shown by the arrow 59 establishing a vortex centrally thereof. Simultaneously, the particulate additive material 57 is dropped into the vortex. As the molten metal strikes the barrier 20 it folds toward the vortex as shown by the arrows 61. The swirl action described provides a delay or sojourn time in the mixing chamber 18 which allows for the mixing of the molten metal with the additive and for its reaction with the molten cast iron to begin and be substantially accomplished before the metal runs out of the downspout 26. The vortex formed is operative to draw the additive into the center of the stream causing the additive to be completely enveloped by the molten metal. The velocity component from the outside diameter of the swirling mass toward the vortex prevents the reacting additive materials from contacting the walls of the apparatus where the build up of reaction products may otherwise occur. The folding action provided by the barrier 20 within the mixing chamber 18 continuously enfolds the additive material and provides a turbulent flow for better mixing, it partially breaks up the swirling motion as to prevent a build up of the molten metal in the mixing chamber and directs the mixed swirling stream toward the vortex to fill the same and thus increase mixing and flow rates of the molten metal through the apparatus.

In a specific example a molten gray disulfurized cast iron melt was prepared having the composition by weight of 4.12% carbon, 0.29% manganese, 0.011% sulfur, 1.81% silicon and a temperature of 2725° F. The molten metal was poured into receiving basin 16 at a controlled rate of 11.6 pounds per second and at the temperature of 2725° F. Simultaneously, the conveyor 52 was operated to deliver a magnesium-silicon-iron alloy into the conduit 56 at a rate of 0.162 pounds per second while subjecting the conduit 56 and the mixing chamber 18 to a supply of nitrogen gas at a pressure of about 21 psi. The nodularizing alloy had a composition by weight of 5% magnesium, 44% silicon, 56% iron and 1% miscellaneous ingredients. The molten cast iron entered the mixing chamber 18 tangentially and immediately developed a swirling configuration with a central vortex. The additive dropped into the vortex continuously as the molten metal struck the barrier 20 it folded over toward the center of the vortex as shown by the arrows in FIG. 4. The sojourn time of the metal in the mixing time within the mixing chamber 18 and the passage 25 was about 3.2 seconds. The treated molten metal flowed into the trough 40 and thence to the ladle 42. Test samples of the molten metal were immediately taken from the ladle and solidified. The samples were found to have 0.295 residual magnesium by weight. Micro results at X100 magnification disclosed 90% nodularity, 50% pearlite and 50% ferrite which is considered a good quality nodular iron.

Figure 5:
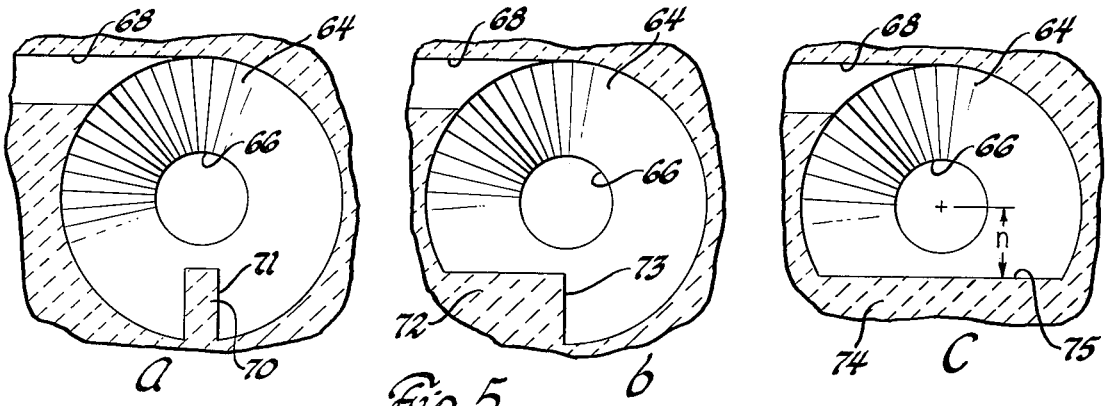
FIG. 5 shows diagrammatic representations of different embodiments.

FIG. 5 illustrates diagrammatically in plan view three workable barrier embodiments located within the mixing chamber 64 and outward of the downspout 66. FIG. 5(*a*) shows a barrier 70 in the form of a rectangular piller located 180° from the tangential inlet 68. This configuration is not preferred because it has inferior strength, provides a stagnant molten metal area behind it which impairs efficient mixing and involves an excessive erosion caused by the molten metal impinging on its radial face 71. FIG. 5(*b*) shows the barrier 72 which is also not preferred because of excessive erosion caused by the impingement of the molten metal on the radial face 73. FIGS. 5(*c*), 8, and FIGS. 1–4 show the preferred barrier configuration. As shown in FIG. 5(*c*), the barrier 74 has a face 75 which extends in the vertical plane of the mixing chamber 64 and the frustoconical portion of the apparatus and located by the chord of a circle defined by a right transverse section of the mixing chamber 18 of FIG. 2. The height of the barrier 74 is at least equal to the maximum height of the molten metal level in the chamber 64 under operating conditions.

Figure 6:
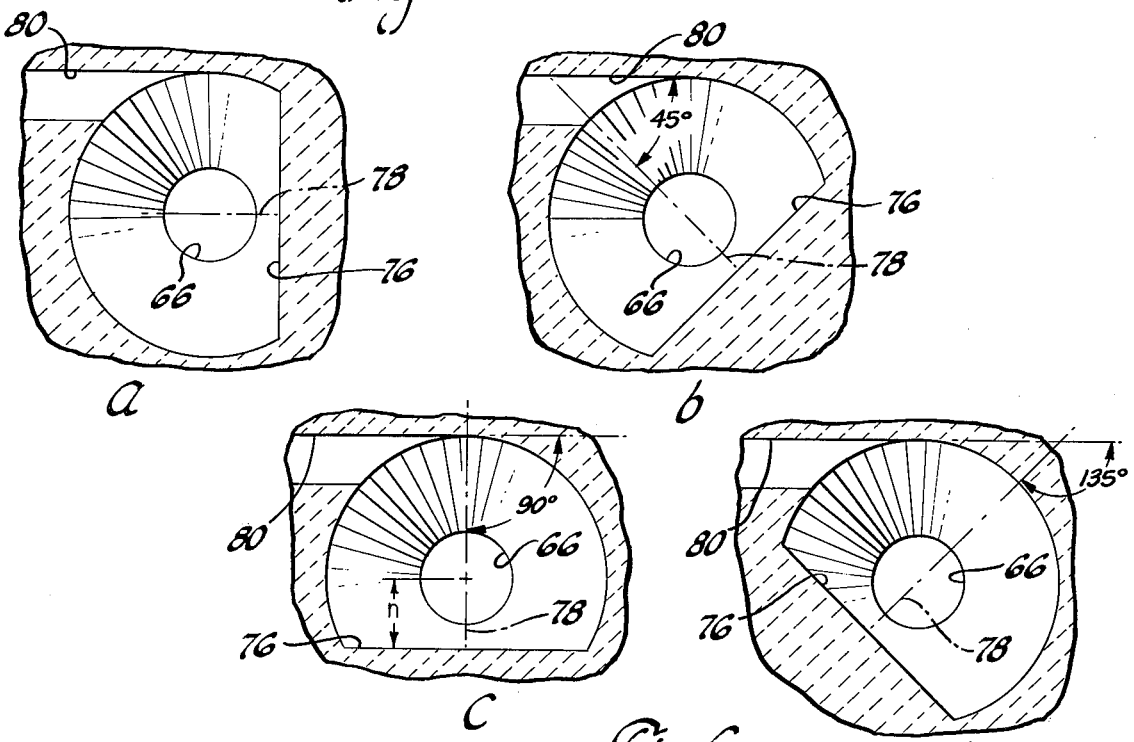
FIG. 6 shows geometric representations of different embodiments.

FIG. 6 illustrates several operative positions of the barrier 74 of FIG. 5(*c*) in terms of geometric Figures. These Figures showed the geometry of the right transverse section taken through the mixing chamber at the level of the inlet 28 of FIG. 2. As shown in FIG. 6(*c*) the orientation of the barrier face 75 of FIG. 5(*c*) is uniquely represented in FIG. 6(*c*) by a normal line 78 perpendicular to and extending outwards from the barrier face 76 which is located at an angle of 90° from the tangent 80 which represents the directional location of the inlet 68 of FIG. 5(*c*). FIG. 6(*b*) shows the normal line 78 located at an angle of 45° to the tangent 80. FIG. 6(*a*) shows the normal line 78 located at an angle of 0° from the tangent 80. FIG. 6(*d*) shows the normal line 78 located at an angle of 135° to the tangent 80. Each of the locations described are satisfactory and any location between about 0° as shown in FIG. 6(*a*) and about 135° as shown in FIG. 6(*d*) are satisfactory with the location of FIG. 6(*c*) being preferred.

The distance of the face 75 of FIG. 5(*c*) of the barrier 74 from the center of the downspout 66 is also important. It has been found that radial distance *n* from the center of the downspout 66 to the face 75 is preferably in the range of the internal diameter of the downspout 66 to three-fourths of this diameter. The distance *n* of FIG. 5(*c*) corresponds to the distance *n* in FIG. 6(*c*) from the center of the downspout 66 to the chord 76 along the normal line 78. This dimension permits the molten metal to develop a sufficient swirl which in cooperation with the folding effect of the barrier accomplishes satisfactory mixing of the molten metal with the particulate additive.

Figure 7:
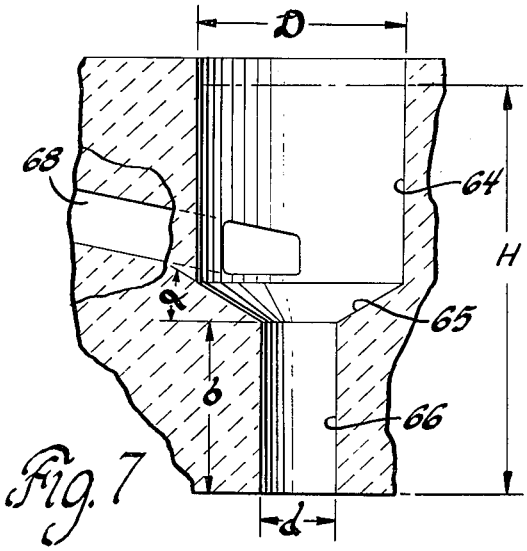
FIG. 7 is a sectional representation showing relative dimensions of the apparatus.
Figure 8:
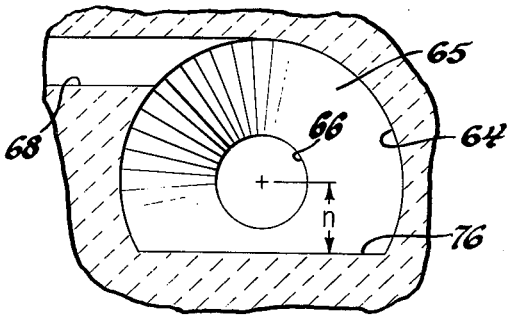
FIG. 8 is a plan sectional representation of FIG. 7.

FIGS. 7 and 8 show diagrammatic sectional views depicting the downspout 66, the mixing chamber 64, the frusto conical portion 65 and the inlet passage 68. Effective operation is obtained with a diameter D of the cylinder being in the range of about three to five times the internal diameter of the downspout 66; with the inverted frusto conical portion 65 having the angle between the side wall thereof and the horizontal plane between about 10° and 30°; and with the height *b* of the downspout being in the range of about the diameter to four times the diameter *d* of the downspout.

In the specific example disclosed herein the diameter D of the cylinder 64 is about nine inches, the internal diameter *d* of the downspout is about two inches, the angle alpha is about 15°, the height *b* of the downspout is about four inches, the height H 12 inches, the distance *n* from the barrier face 76 to the center of the downspout 1½ inches, with the position of the barrier being as in FIG. 6(*c*).

As previously stated the above dimensions produce operative embodiments and are intended to be illustrative. It is expected that variations somewhat outside the dimensions will product satisfactory results. For example the sojourn time within the mixing chamber and downspout may be further extended if desirable by the addition of an "L" shaped conduit or other tortuous passage to the lower end of the downspout. The apparatus should be operative to delay metal flow therein long enough to allow the additive material to be mixed into the center core of the metal leaving the apparatus.

Another advantage of the apparatus is that it permits the separation of the source of the treatment material from contact with the molten metal. It also permits the mixing operation to occur in an enclosed chamber wherein an inert atmosphere is provided to help avoid explosive incidents resulting from contact of the volatile vapors such as those of magnesium with air. The inert atmosphere also increases the efficiency of additive material utilization since the volatile vapors are not permitted to escape. The folding action due to the barrier also has the beneficial effect of immediately enveloping the additive to prevent undue explosive action of components such as magnesium coming into contact with the molten metal.

As previously indicated, the process involves feeding the molten cast iron at a rate such as to develop a sufficient head or molten metal level H (FIG. 7) so as to permit the molten metal to lie over or fold over the additive and thereby effect efficient nodularization. In general, a greater molten metal head over the additive promotes more effective nodularization.

Although this invention has been described in terms of specific embodiments, it is obvious that variations may be adopted within the scope of this invention.

What is claimed is:

1. In a method for making nodular iron the steps of mixing additive materials into the molten cast iron comprising:

continuously bringing a stream of molten metal tangentially into a bottom-pour chamber at a cylindrical portion thereof so that said stream assumes a swirling configuration and forms a vortex in said chamber, impinging said stream against a barrier positioned in the path of said swirling stream so that at least a portion of said stream folds over itself and falls toward the center of said vortex, continuously introducing said additive materials into said vortex, said stream portion falling toward the center of said vortex being operative to promote the mixing of said material and said metal and to increase the downward flow rate of said swirling stream.

2. A method for making nodular cast iron comprising:

continuously bringing a stream of molten gray cast iron tangentially into a bottom-pour chamber at a cylindrical portion thereof so that said stream assumes a swirling configuration and forms a vortex in said chamber, impinging said stream against a barrier positioned in the path of said swirling stream so that at least a portion of said stream folds over itself and falls toward the center of said vortex, continuously introducing a magnesium containing alloy into said vortex, said stream portion falling toward the center of said vortex being operative to promote the mixing of said alloy and said molten metal and to increase the downward flow rate of said swirling stream.

3. A method for making nodular cast iron comprising:

continuously bringing a stream of molten gray cast iron tangentially into a bottom-pour chamber at a cylindrical portion thereof so that said stream assumes a swirling configuration and forms a vortex in said chamber, impinging said stream against a barrier positioned in the path of said swirling stream so that at least a portion of said stream folds over itself and falls toward the center of said vortex, continuously introducing a magnesium containing alloy into said vortex while providing an inert environment over said vortex, said stream portion falling toward the center of said vortex being operative to promote the mixing of said material and said metal and to increase the downward flow rate of said swirling stream.

4. Apparatus for mixing molten cast iron with a particulate material to make nodular iron comprising:

a cylindrical chamber portion, adapted for receiving molten metal up to a predetermined level, a frusto-conical chamber portion attached to the bottom of said cylindrical portion, a downspout portion of lesser internal dimensions than the internal dimensions of said cylindrical portion attached to the bottom of said frusto-conical portion, said cylindrical portion having an inlet passage positioned at a tangent to the wall of said cylindrical portion, a rigidly positioned barrier between said cylindrical wall and said frusto-conical portion having a vertical wall extruding to said level, said cylindrical chamber being operative to receive molten metal through said inlet passage in a swirling motion to form a vortex and said barrier being operative to fold a portion of said swirling molten metal into said vortex, means for admitting said particulate material into said vortex.

5. Apparatus for mixing molten cast iron with a particulate material to make nodular iron comprising:

a cylindrical chamber portion, adapted for receiving molten metal up to a predetermined level, a frusto-conical chamber portion attached to the bottom of said cylindrical chamber portion, a downspout portion of lesser internal dimensions than the internal dimensions of said cylindrical portion attached to the bottom of said frusto-conical portion, said cylindrical portion having an inlet passage positioned at a tangent to the wall of said cylindrical portion, a rigidly positioned barrier within said cylindrical portion and between said cylindrical wall and said downspout and said frusto-conical portion having a vertical wall defined by a chord of a circle defined by a right transverse plane through said cylinder, said chord being located a distance from the center of said circle of about the internal diameter to about ¾ the internal diameter of said downspout portion and perpendicular to a line located between 0° and 135° from said tangent, said perpendicular line extending outwardly from said chord, and means for admitting said particulate material into said chamber.

6. Apparatus for mixing molten cast iron with a particulate material to make nodular iron comprising:

a cylindrical chamber portion, a frusto-conical chamber portion attached to the bottom of said cylindrical portion, a downspout portion of lesser internal dimensions than the internal dimensions of said cylindrical portion attached to the bottom of said frusto-conical portion, a pouring basin for receiving molten metal, an inlet conduit in communication with said pouring basin and said cylindrical chamber portion and positioned at a tangent to said cylindrical portion, a rigidly positioned barrier between said cylindrical wall and said frusto-conical portion having a vertical wall extending to said level, said cylindrical chamber being operative to receive molten metal from said basin through said inlet passage in a swirling motion to form a vortex and said barrier being operative to fold a portion of said swirling molten metal into said vortex, means for admitting said particulate material into said vortex, and means for providing an inert environment over said vortex.

7. Apparatus for mixing molten cast iron with a particulate material to make nodular iron comprising:

a cylindrical chamber portion adapted for receiving molten metal up to a predetermined level, a frusto-conical portion attached to the bottom of said cylindrical portion, a downspout portion of lesser internal dimensions than the internal dimensions of said cylindrical portion attached to the bottom of said frusto-conical portion, said cylindrical portion having an inlet passage positioned at a tangent to the wall of said cylindrical portion, a rigidly positioned barrier between said cylindrical wall and said frusto-conical portion having a vertical wall extending to said level, said cylindrical chamber being operative to receive molten metal through said inlet passage in a swirling motion to form a vortex and said barrier being operative to fold a portion of said swirling molten metal into said vortex, and means for admitting said particulate material into said vortex, said cylindrical chamber portion, said frusto-conical portion and said downspout being proportioned to cause the molten metal admitted to said cyindrical chamber to rise to said level and to provide a sojourn time for the molten metal in said apparatus to react with said material to form nodular iron or casting.

* * * * *